US009630156B1

(12) United States Patent
Ries

(10) Patent No.: US 9,630,156 B1
(45) Date of Patent: Apr. 25, 2017

(54) FLUID HOLDING STRUCTURE FLUID CIRCULATING SYSTEM

(71) Applicant: John Ries, Elk Point, SD (US)

(72) Inventor: John Ries, Elk Point, SD (US)

( * ) Notice: Subject to any disclaimer, the term of this patent is extended or adjusted under 35 U.S.C. 154(b) by 53 days.

(21) Appl. No.: 14/133,244

(22) Filed: Dec. 18, 2013

(51) Int. Cl.
*B01F 7/22* (2006.01)
*B01F 7/00* (2006.01)

(52) U.S. Cl.
CPC ..... *B01F 7/00341* (2013.01)

(58) Field of Classification Search
CPC .... B01F 7/22; B01F 7/00208; B01F 7/00341; B01F 7/00733
USPC ..... 366/270; 261/84
See application file for complete search history.

(56) References Cited

U.S. PATENT DOCUMENTS 4,014,526 A * 3/1977 Cramer, Jr. ..... B01F 3/04531 366/155.1
4,642,919 A 2/1987 Werner et al.
4,746,221 A * 5/1988 Okumura ..... G01S 5/30 366/142
6,231,268 B1 * 5/2001 Hausenbauer ..... 405/61
8,191,868 B2 6/2012 Tooley et al.
D673,178 S 12/2012 Tatic
8,517,700 B2 8/2013 Liberg
2005/0061721 A1 * 3/2005 Tormaschy ..... B01F 3/04609 210/121
2007/0131624 A1 * 6/2007 Giti ..... B01F 5/0218 210/739
2010/0080077 A1 * 4/2010 Coy ..... B01F 5/0206 366/137
2012/0263606 A1 10/2012 Bouldin et al.

FOREIGN PATENT DOCUMENTS

EP 2006546 12/2008
GB 2462930 8/2009
WO WO2006/001800 1/2006
WO WO2008060288 5/2008

* cited by examiner

*Primary Examiner* — Tony G Soohoo
*Assistant Examiner* — Elizabeth Insler

(57) ABSTRACT

A fluid holding structure fluid circulating system includes a fluid movement assembly for urging fluid upwardly towards a surface of the fluid holding structure. The fluid movement assembly includes a frame that is positionable on a floor of a fluid holding structure. The frame includes a lower section and an upper section. A motor is mounted to the upper section of the frame and a propeller is mounted on the motor such that the propeller is above the frame. The propeller urges fluid upwardly away from the frame when the motor is turned on to rotate the propeller.

13 Claims, 6 Drawing Sheets

FLUID HOLDING STRUCTURE FLUID CIRCULATING SYSTEM

BACKGROUND OF THE DISCLOSURE

Field of the Disclosure

The disclosure relates to fluid circulating devices and more particularly pertains to a new fluid circulating device for causing large circulation currents within a fluid holding structure without being hampered by material within the fluid.

SUMMARY OF THE DISCLOSURE

An embodiment of the disclosure meets the needs presented above by generally comprising a fluid movement assembly configured to urge fluid upwardly towards a surface of the fluid holding structure. The fluid movement assembly includes a frame configured to be positionable on a floor of a fluid holding structure. The frame includes a lower section and an upper section. A motor is mounted to the upper section of the frame and a propeller is mounted on the motor such that the propeller is above the frame. The propeller urges fluid upwardly away from the frame when the motor is turned on to rotate the propeller.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
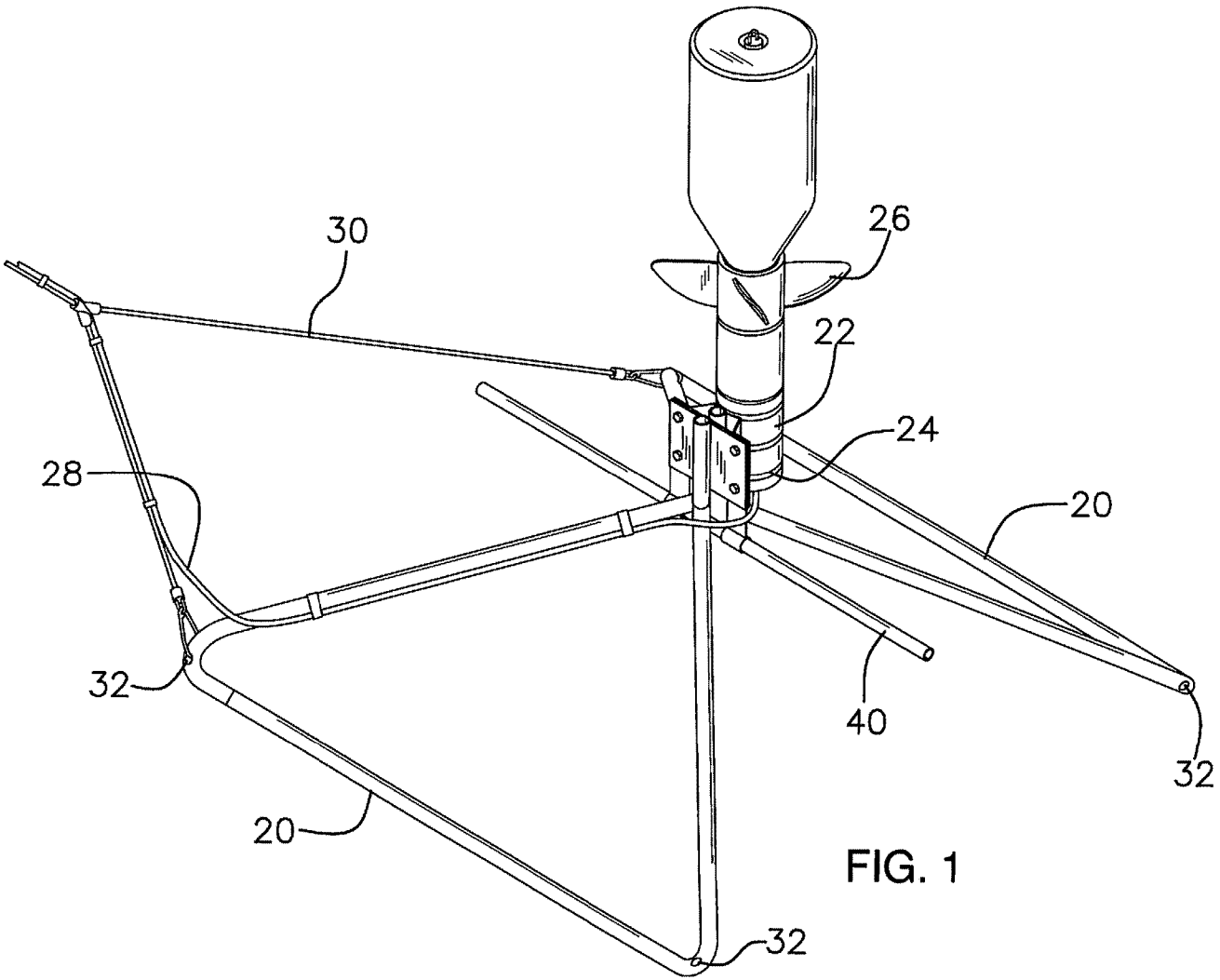
FIG. 1 is a perspective top view of a fluid holding structure fluid circulating system according to an embodiment of the disclosure.
Figure 2:
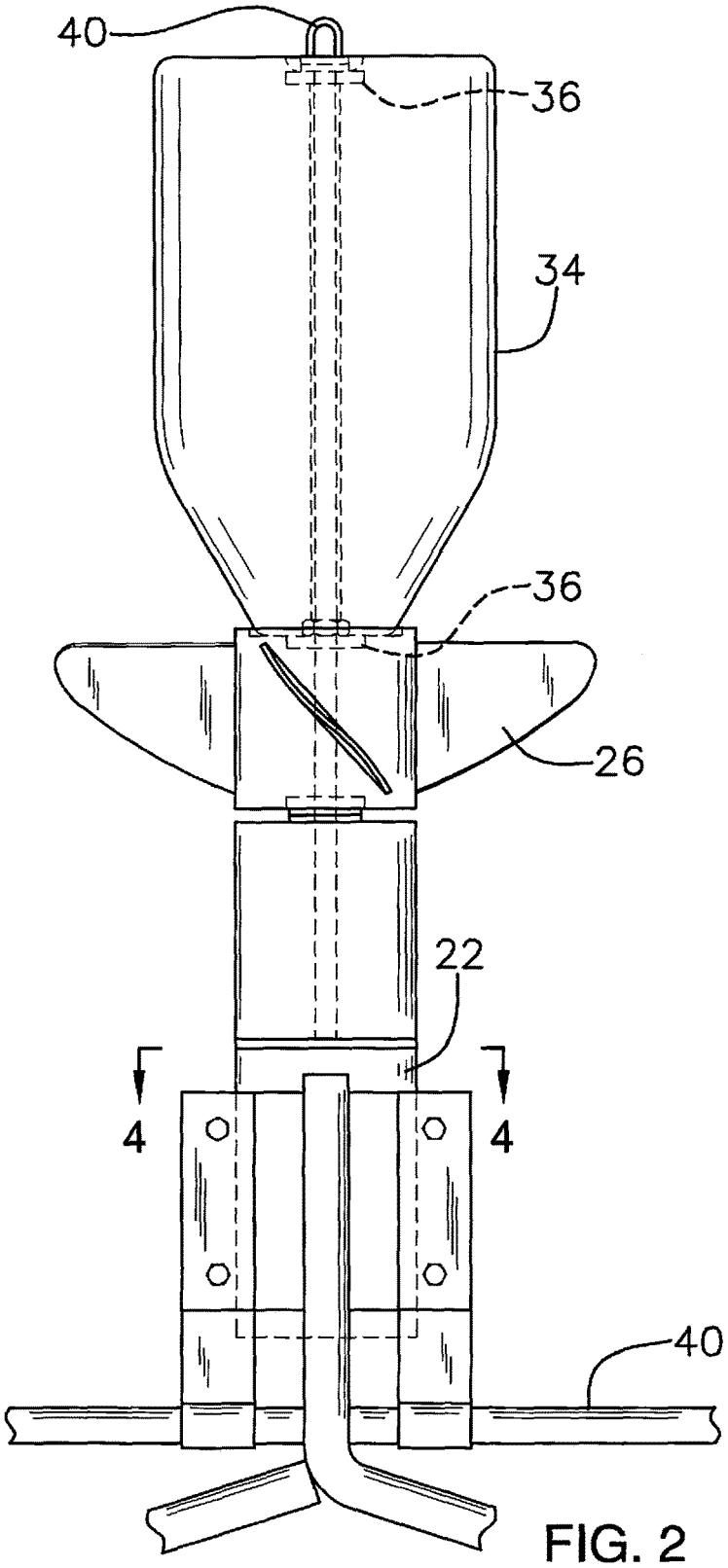
FIG. 2 is a front broken view of an embodiment of the disclosure.

With reference now to the drawings, and in particular to FIGS. 1 through 6 thereof, a new fluid circulating device embodying the principles and concepts of an embodiment of the disclosure and generally designated by the reference numeral 10 will be described.

As best illustrated in FIGS. 1 through 6, the fluid holding structure fluid circulating system 10 generally comprises a fluid movement assembly 12 configured to urge fluid upwardly towards a surface 71 of the fluid holding structure 70. The fluid holding structure 70 may comprise a pit, a pond, a tank or the like typically used for retaining fluids during the breaking down of organic materials. The purpose of moving fluid vertically through the fluid holding structure 70, generally, is to homogenize the fluid and further to prevent localized areas of oxygen deprived fluid which leads to anaerobic bacterial growth as is well known in the retention fluid holding structure arts. However, it should be understood that the system 10 may be used for general water circulation/oxygenation ponds such as, for instance, a fish farm and the fluid may substantially comprise water. The fluid movement assembly 12 includes a frame 14 configured to be positionable on a floor 72 of the fluid holding structure 70. More particularly, the frame 14 may include a lower section 16 and an upper section 18 wherein the lower section 16 is specifically designed to engage the floor 72 in a suitable manner. For example, the lower section 16 may include a pair of elongated members 20 that are oriented parallel to each other and which are within in a horizontal plane. As such, the elongated members 20 act as skies allowing the frame 14 to slide along the floor 72 and to rest upright on a ground surface when removed from the fluid.

Figure 4:
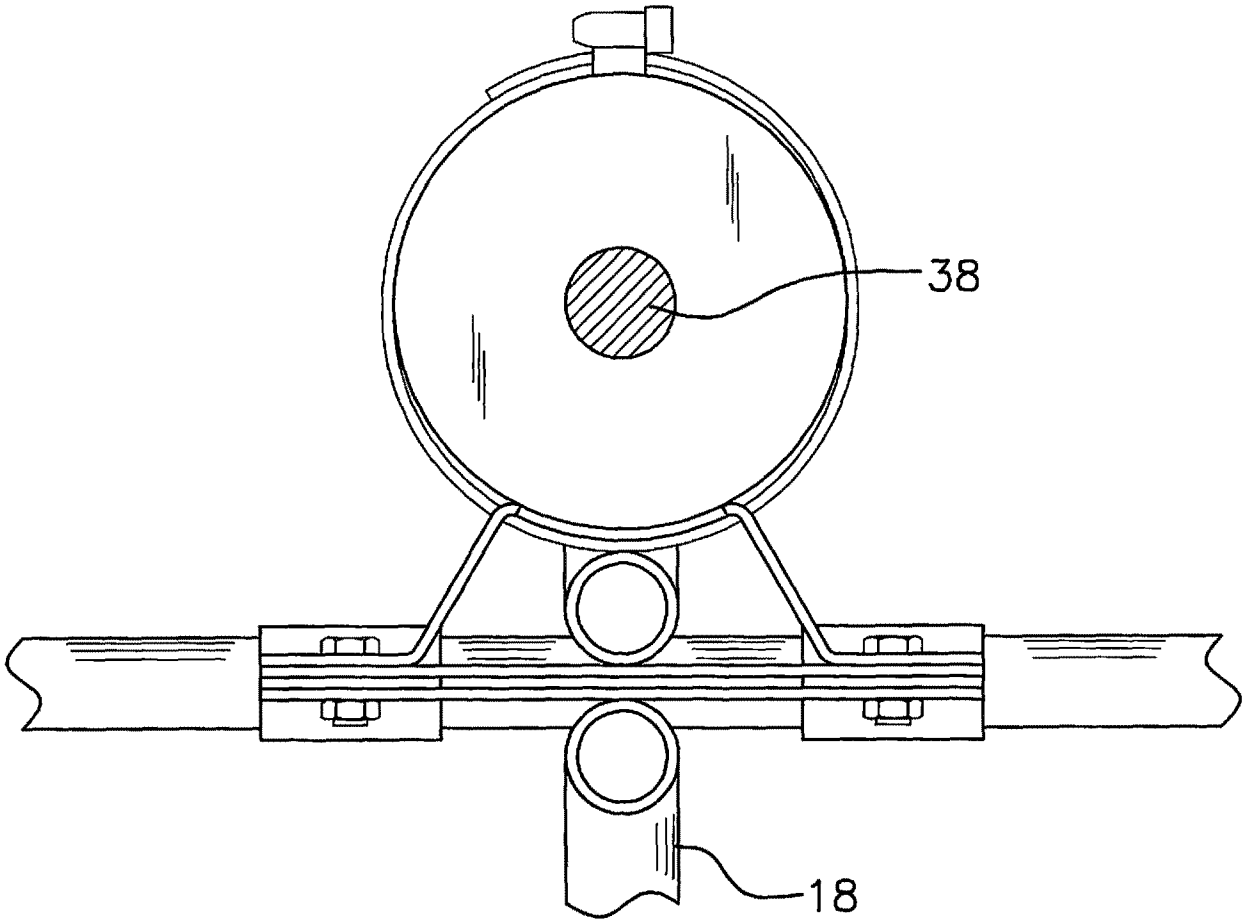
FIG. 4 is a cross-sectional view of an embodiment of the disclosure taken along line 4-4 of FIG. 2.
Figure 5:
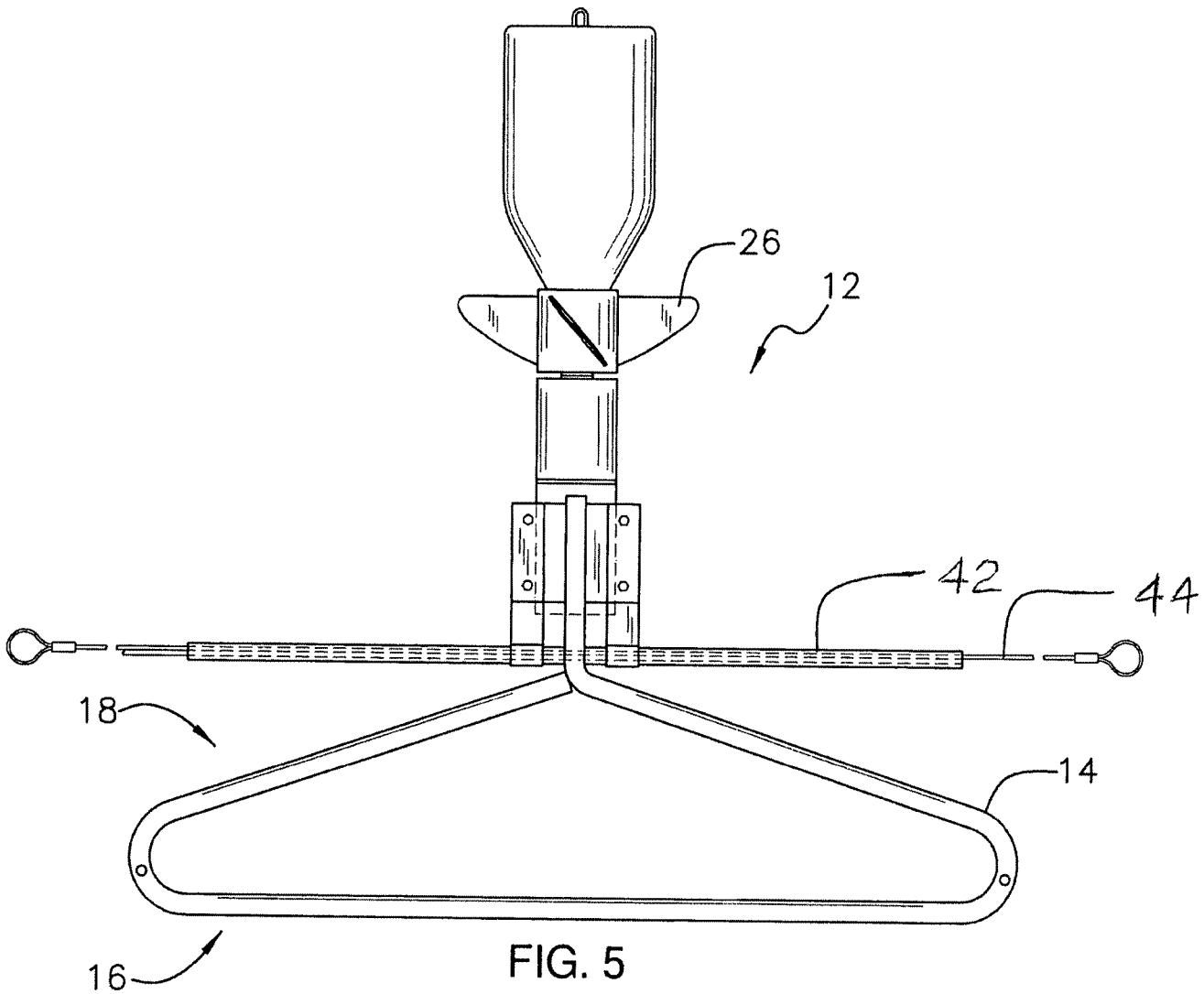
FIG. 5 is a front view of an embodiment of the disclosure.

The fluid movement assembly 12 further includes a motor 22 mounted to the frame 14 and which may be positioned adjacent to the upper section 18 of the frame 14. As can be seen in FIG. 4, the motor 22 may be attached to the frame 14 by one or more fasteners 24 such as brackets. The motor 22 will typically comprise an electric motor. A propeller 26 is mounted on the motor 22 such that the propeller 26 is above the frame 14. A gearbox, not numbered but shown between the propeller 26 and the motor 22, may be included to adjust the rotation speed of the propeller 26 relative to the rotational output speed of the motor 22. The propeller 26 urges fluid upwardly away from the frame 14 when the motor 22 is turned on to rotate the propeller 26 and the motor 22 may have variable speed capabilities. This drives the fluid movement assembly 12 downward so that the frame 14 engages the floor. The propeller 26 is completely exposed around its lateral periphery and is mounted at an apex of the fluid movement assembly 12. It is therefore outside of the frame 14 and is not encased within a housing. Moreover, it should be understood that the entire assembly 10 and system is submerged below the surface 71. This mounting position forces fluid upwardly without pulling fluid holding structure 70 material through a housing as is found in other circulation devices. This in turn prevents the propeller 26 from being inundated with and hampered by plant material or other material which is often found in such fluid holding structures 70. For instance, animal fecal and birth materials as well as twine and other "stringy" elements are often found in retention ponds and can hamper efficiency of the propeller 26. To power the motor 22 a power cord 28 is electrically coupled to the motor 22. The power cord 28 may simply be extended outwardly of the fluid holding structure 70 or attached to draw lines 30 attached to the frame 14 such as by extending the draw lines 30 through openings 32 in the frame 14. The power cord 28 may then be conventionally electrically coupled to any electrical power source. The draw lines 30 may be used to reposition the fluid movement assembly 12 as needed.

It should be noted that elements 10 and 12 differ in that element 12 includes the assembly as described above generally whereas element 10 includes element 12 and those attachments and usages thereto described below.

Figure 3:
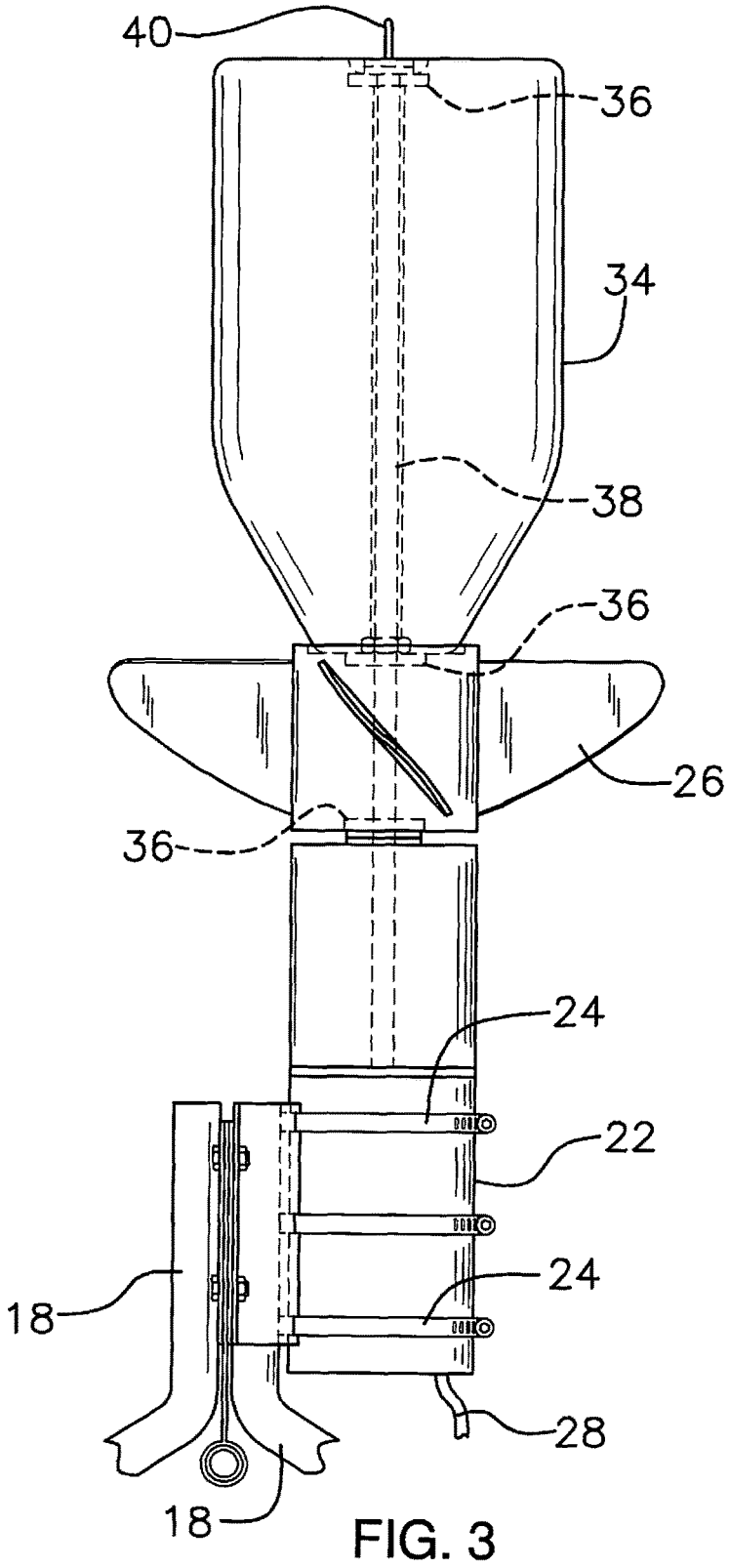
FIG. 3 is a side broken view of an embodiment of the disclosure.

As shown particularly in FIG. 3, a buoy 34 is attached to the fluid movement assembly 12. The buoy 34 has a predetermined buoyancy in fluid great enough to raise the fluid movement assembly 12 adjacent to the surface 71 of the fluid holding structure 70 when the motor 22 is turned off or is sufficiently powered down. The buoy 34 may be mounted adjacent to a mount of the propeller 26 and is positioned above the propeller 26 and more particularly a thrust bearing 36 may be utilized to allow the buoy to be rotatable with respect to the propeller. The buoy 34 may therefore be coupled to the propeller 26 by a tube 38 attached to the propeller 26 and extending through the buoy 34. Bearings, or thrust bearings 36, positioned between the buoy 34 and the tube 38 allow the buoy 34 to rotate independently of the propeller 26. The buoy 34, or the tube 38, may include a loop 40 for engagement with lift lines to tether the buoy 34 to a boat or other structure, for instance, to lift the assembly 12 from the fluid.

Figure 6:
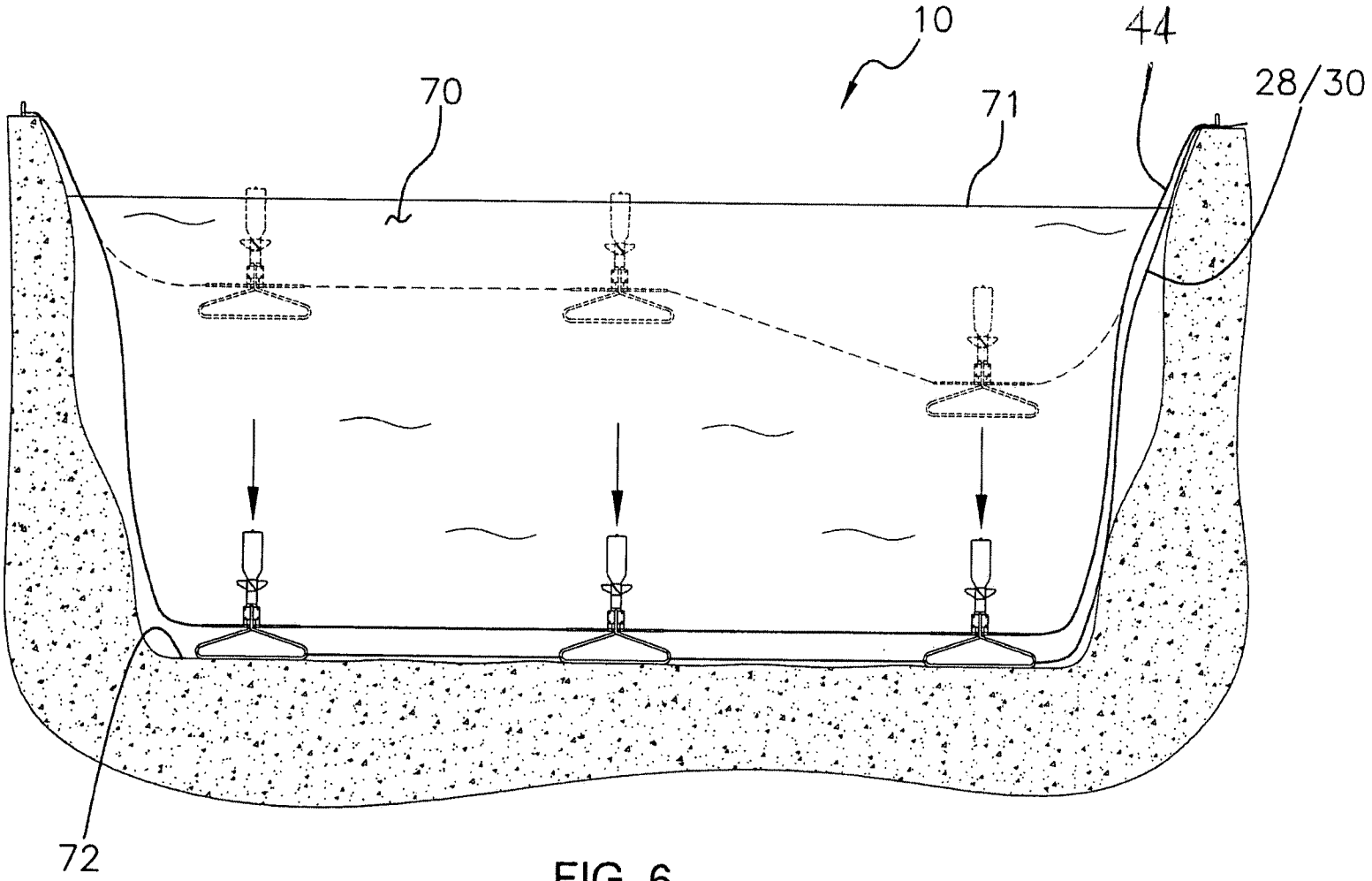
FIG. 6 is a front in-use view of an embodiment of the disclosure.

A coupler 42, defining a receiver, may be attached to the fluid movement assembly 12 and is configured to receive a guide line 44. The coupler 42 may comprise an elongated tubular member, or a series of loops, oriented parallel to the elongated members 20. The guide line 44 is extendable through multiple couplers of multiple ones of the circulator systems 10 as shown in FIG. 6. This ensures that when multiple ones of the systems 10 are used that they are aligned with each other in an efficient manner. Precise placement of the systems 10 may be done with the draw lines 30 as described above. The guide line 44, and draw lines 30, also advantageously prevents the rotation of the assembly 10 caused by rotation of the propeller 26 and motor 22.

In use, one or more of the systems 10 is placed in a fluid holding structure 70. If the buoy 34 is used, it will retain the system 10 in a floating condition adjacent to the surface 71 of the fluid holding structure 70. As the motor 22 is turned on and power increased, the propeller 26 drives the system 10 downward toward the floor 72 of the fluid holding structure 70. Thus, utilizing less than full power of the motor 22 may cause the system 10 to float above the floor 72 as indicated by the lines in phantom of FIG. 6. The frame 14 may be constructed in shape and weight to retain the system 10 in a generally upright configuration as shown in FIG. 6. As can be seen in the Figures, the frame 14 forms a very wide base with respect to the position and size of the motor 22 and propeller 26. When the propeller 26 is turned on, its position and direction of rotation drives fluid upwardly towards the surface 71 to ensure homogenization of the fluid and surface oxygenation of the fluid to enhance preferable bacterial activity to consume waste materials in the fluid.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A circulator system configured to be positioned within a fluid holding structure and to circulate fluid within the fluid holding structure, said system comprising:

a fluid movement assembly configured to urge fluid upwardly towards a surface of fluid held in the fluid holding structure, said fluid movement assembly including:

a frame configured to be positionable on a floor of a fluid holding structure, said frame including a lower section and an upper section;

a motor being mounted to said upper section of said frame;

a propeller being mounted on said motor such that said propeller is above said frame, said propeller urging fluid upwardly away from said frame when said motor is turned on to rotate said propeller; and a buoy being attached to said fluid movement assembly, said buoy being configured to have a buoyancy in fluid such that when said motor of said fluid movement assembly is turned off said buoy and said fluid movement assembly rise to be positioned adjacent to the surface of the fluid of the fluid holding structure and said buoy penetrates the surface of the fluid, said fluid movement assembly being configured to completely pull said buoy and said fluid movement assembly under the surface when said motor of said fluid movement assembly is turned on, said buoy being affixed to said fluid movement assembly such that a distance between said buoy and said frame is static.

2. The circulator system according to claim 1, wherein said lower section of said frame includes a pair of elongated members being oriented parallel to each other and in a horizontal plane, said elongated members allowing said frame to slide along the floor, wherein said pair of elongated members define a lowermost portion of said lower section such that said elongated members are configured to be an only portion of said lower section engaging said floor.

3. The circulator system according to claim 1, wherein said motor is an electric motor.

4. The circulator system according to claim 1, wherein said propeller is completely exposed around its lateral periphery.

5. The circulator system according to claim 1, wherein said propeller is mounted at an apex of said fluid movement assembly.

6. The circulator system according to claim 4, wherein said propeller is mounted at an apex of said fluid movement assembly.

7. The circulator system according to claim 1, wherein said buoy is positioned above and adjacent to said propeller, said propeller having an axis of rotation being aligned with an axis of said buoy extending through a bottom and a top of said buoy.

8. The circulator system according to claim 7, wherein said buoy is rotatable with respect to said propeller.

9. The circulator system according to claim 1, further including a coupler being attached to said fluid movement assembly, said coupler being configured to receive a guide line.

10. The circulator system according to claim 9, wherein said coupler comprises an elongated tubular member being oriented parallel to said elongated members wherein the guide line is extendable through multiple couplers of multiple ones of said circulator systems.

11. The circulator system according to claim 1, wherein said buoy extends upwardly above said propeller, wherein said propeller is between said buoy and said frame.

12. A circulator system configured to be positioned within a fluid holding structure and to circulate fluid within the fluid holding structure, said system comprising:

a fluid movement assembly configured to urge fluid upwardly towards a surface of fluid held in the fluid holding structure, said fluid movement assembly including:

a frame configured to be positionable on a floor of a fluid holding structure, said frame including a lower section and an upper section, said lower section including a pair of elongated members being oriented parallel to each other and in a horizontal plane, said elongated members allowing said frame to slide along the floor;

a motor being mounted to said upper section of said frame, said motor being an electric motor;

a propeller being mounted on said motor such that said propeller is above said frame, said propeller urging fluid upwardly away from said frame when said motor is turned on to rotate said propeller, said propeller being completely exposed around its lateral periphery, said propeller being mounted at an apex of said fluid movement assembly;

a buoy being attached to said fluid movement assembly, said buoy having a buoyancy in fluid great enough to raise said fluid movement assembly adjacent to the surface of the fluid holding structure when said motor is turned off, said buoy being mounted to a mount of said propeller and being positioned above said propeller, said buoy being rotatable with respect to said propeller, said fluid movement assembly completely pulling said buoy under the surface when said motor is turned on, said buoy being affixed to said fluid movement assembly such that a distance between said buoy and said frame is static, said propeller having an axis of rotation being aligned with an axis of said buoy extending through a bottom and a top of said buoy; and a coupler being attached to said fluid movement assembly, said coupler being configured to receive a guide line, said coupler comprising an elongated tubular member being oriented parallel to said elongated members wherein the guide line is extendable through multiple couplers of multiple ones of said circulator systems.

13. The circulator system according to claim 12, wherein said buoy extends upwardly above said propeller, wherein said propeller is between said buoy and said frame.

* * * * *